United States Patent [19]

Torstensson

[11] 4,059,008

[45] Nov. 22, 1977

[54] METHOD AND DEVICE FOR PORE PRESSURE SOUNDING

[76] Inventor: Bengt-Arne Torstensson, 34 Hojdvagen, Vallentuna, Sweden, S-186 00

[21] Appl. No.: 691,104

[22] Filed: May 28, 1976

[30] Foreign Application Priority Data

May 30, 1975 Sweden ..... 7506205

[51] Int. Cl.[2] ..... G01N 3/00

[52] U.S. Cl. ..... 73/38; 73/84

[58] Field of Search ..... 73/38, 64.3, 84, 88 E

[56] References Cited

U.S. PATENT DOCUMENTS 3,906,781 9/1975 Vlasblom ..... 73/88 E X

FOREIGN PATENT DOCUMENTS 825,443 12/1937 France ..... 73/38

1,236,655 6/1960 France ..... 73/84

817,295 7/1959 United Kingdom ..... 73/38

*Primary Examiner*—Richard C. Queisser

*Assistant Examiner*—Joseph W. Roskos

*Attorney, Agent, or Firm*—Pollock, Vande Sande & Priddy

[57] ABSTRACT

An improved method and apparatus are disclosed for determining the nature of soil layers by driving a sound carrying a pressure transducer continuously through the soil, measuring the transient pressure generated as the probe moves continuously and then correlating the transient pressure to soil type and condition.

5 Claims, 2 Drawing Figures

METHOD AND DEVICE FOR PORE PRESSURE SOUNDING

BACKGROUND OF THE INVENTION
embodiment

This invention relates to a method and a device for pore pressure sounding. For earlier methods of sounding soil layers, various types of sounding equipment have been used, in which the appliance is fitted with a sounding probe. In order to find out the structure of a soil layer, a registration has been made of the penetration force.

PURPOSE AND SUMMARY OF THE INVENTION

The purpose of the present invention is to provide an entirely new method of sounding soil layers, in which variations in permeability in different soils are used for determining the structure (stratigraphy) of a soil layer.

This is done by using a method of pore pressure sounding according to which a sounding probe containing a filter and a pressure transducer is continuously driven down into a soil layer with simultaneous registration, via the filter and pressure transducer, of the pore pressure generated by the intrusion of the sound.

BRIEF DESCRIPTION OF THE DRAWING

The invention will be described below with reference to the accompanying drawings showing an embodiment of the device for carrying out the method described above, in which.

DETAILED DESCRIPTION OF THE PREFERRED EMBODIMENT

Figure 1:
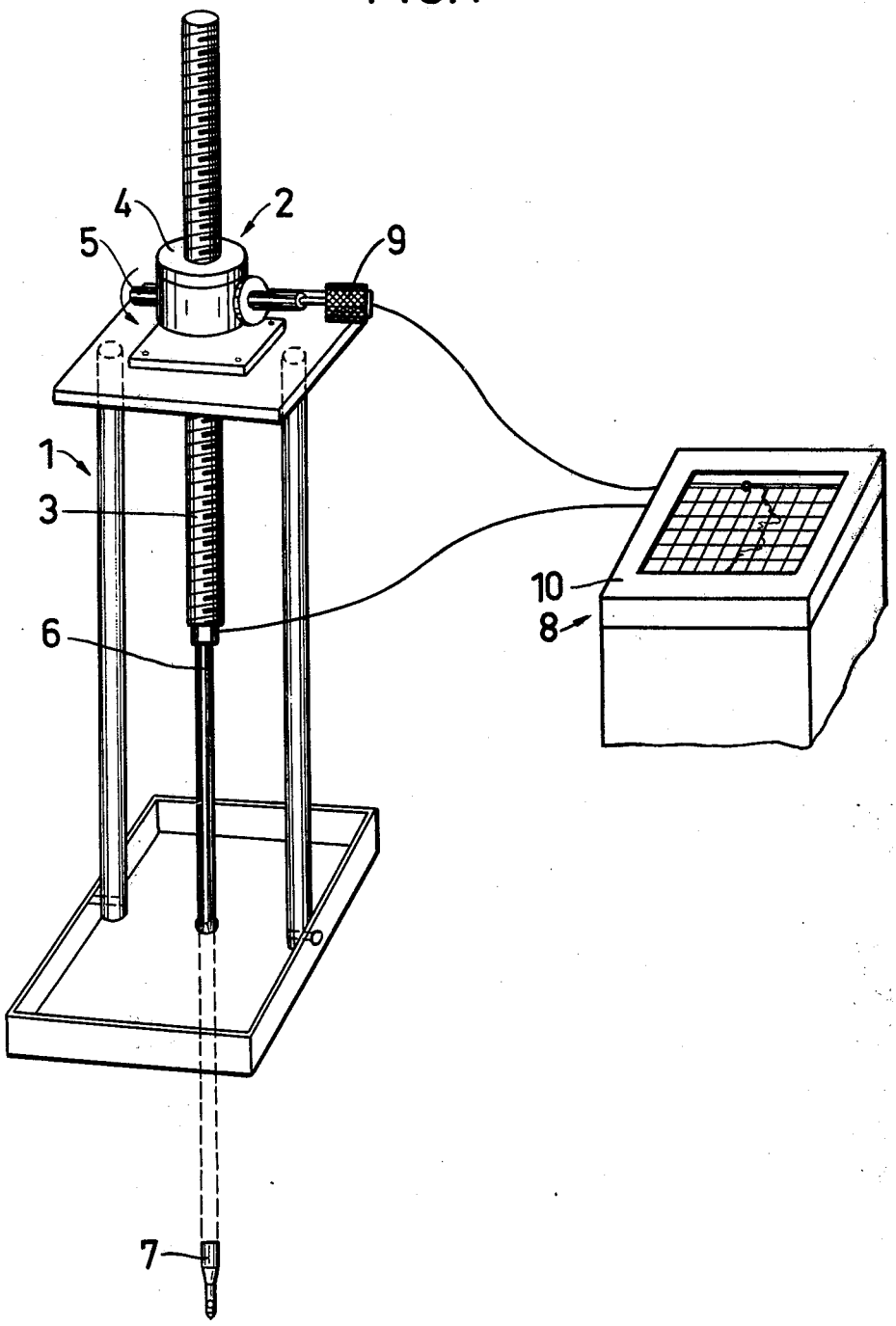
FIG. 1 shows schematically a complete device for pore pressure sounding.

FIG. 1 shows an embodiment of the device for pore pressure sounding. The device includes a frame 1 which supports a screw jack 2. The screw jack 2 includes a screw 3 and a worm gear 4. By rotating an axle 5 which forms part of the worm gear, the screw 3 can be made to move vertically upwards or downwards. At the lower end of screw 3 a sounding rod 6 is attached, which bears a sound 7 at its lower end.

The movement of screw jack 2 and sounding rod 6 is monitored by a recording instrument 8. This instrument includes a separate pulse generator 9, which is connected to the drive axle 5 of the worm gear 4. The pulse generator 9 is connected to a recorder 10, which is also connected to the sounding rod 6. The pulse generator 9 delivers pulses to a step motor (not shown), which drives a strip of paper in the recorder 10. The measurement signals from the sound 7 are registered on this paper. The number of pulses per time unit delivered by the pulse generator is dependent on the speed of rotation of the drive axle 5. As there is a well defined relation between the vertical movement of the screw 3 and the rotation of the drive axle, it is therefore possible to obtain a well defined relation between the length of paper driven through the recorder 10 and the depth to which the sound 7 is driven.

Figure 2:
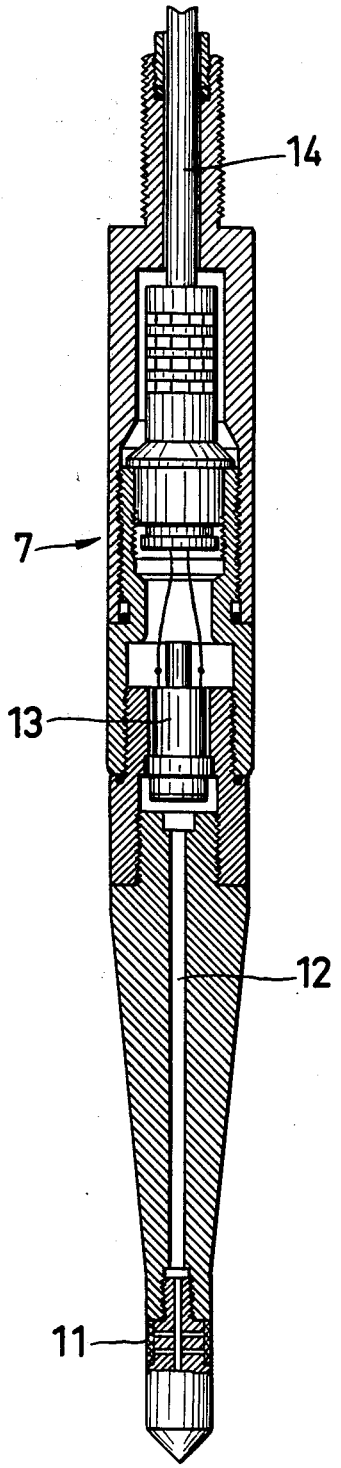
FIG. 2 shows a section through the sound.

FIG. 2 shows at a larger scale an emboidment of the sound 7 shown schematically in FIG. 1. As shown in FIG. 2, the sound 7 has an upper cylindrical part and a lower conical part. At the lower end of the conical part of the sound 7 there is a filter 11 of stainless steel mesh. This filter 11 is connected via a duct 12 in the sound 7 to a pressure transducer 13. This pressure transducer 13 is then connected to the recorder 10 via an electric cable 14 in the sounding rod 6.

The method of pore pressure sounding with the device described above is as follows: The sound 7 is driven downwards at a constant speed by of the screw jack 2 into the soil layer to be investigated. The penetration of the sound 7 into a soil layer generates an expansion pressure. This expansion pressure is composed of a generated pore pressure due to fluids in the soil pores moving to and from the probe and a generated effective pressure due to pressure from the soil particles. The filter 11 conveys the total pore pressure present in the soil, which consists of the sum of the generated pore pressure and the pore pressure in the surrounding undisturbed soil, to the pressure transducer 13, thereby producing a signal which passes via the electric cable 14 to be registered by the recorder 10.

As different generated soils have different permeability, different pore pressures will be encountered at different levels during the sounding. In normally consolidated clay, for example, a high excess pore pressure will be encountered, as clay has a low permeability. Sand, on the other hand, has a high permeability, which means that the generated pore pressure is insignificant compared to that encountered in normally consolidated clay, for example. The sound 7 is driven down continuously through a soil layer with simultaneous recording of the generated pore pressure via the recording instrument 8.

If the pore pressure sounding described above is made in a clay which contains permeable layers of, for example, sand, these will be recorded as sudden drops in generated pore pressure as the sounding probe moves through these layers. The generated pore pressures, which are continuously recorded, are thus transient and a function of the character of different soil types, especially of permeability. By studying the recorded variations in generated pore pressure, it is therefore possible to obtain a picture of the structure (stratigraphy) of a soil layer.

This invention is not limited to the embodiment described above. For example, the sound can have a modified shape differing from that shown in FIG. 2 without departure from the idea of the invention. Also, the penetration and recording devices can have another construction than the one shown. However, the condition which must apply to these devices is that the penetration of the sound be done continuously with simultaneous registration of generated pore pressures at a speed which is sufficient to ensure that the generated or transient pore pressures are recorded. The invention can thus vary within the scope of the following patent claims.

What is claimed is:

1. A method of determining the characteristics of succesive layers of soil using a sounding probe of the type having a pressure transducer, a filter separating the transducer from soil layers surrounding the sounding probe and means for monitoring the output of the pressure transducer, comprising the steps of: driving said sound probe through a body of soil at a speed sufficient to produce transient variations in the transducer output corresponding to transient variations in the generated pore pressure of the soil encountered by the probe during movement; simultaneously with said driving, recording the output of said pressure transducer as a function of the depth of said sounding probe in said soil.

2. The method of claim 1, wherein said driving step is at constant speed.

3. Apparatus for determining the characteristics of successive layers of soil, comprising: an elongated sound having a first, cylindrical crossection at its uppermost end and a second, conical crossection at its lowermost end; a filter located at the lower end of said conical crossection; a pressure transducer located within said sound in communication with said filter for measurement of pore pressures generated by penetration of said sound; means for recording the output of said pressure transducer; and means for moving said sound through successive soil layers at a speed sufficient to produce transient variations in the transducer output corresponding to transient variations in the generated pore pressures of the soil encountered by the sound during the movement, whereby pore pressures measured by said transducer as said sound moves may be correlated with the characteristics of the soil traversed by said sound.

4. Apparatus according to claim 3, wherein said means for moving said sound comprises a screw jack.

5. Apparatus according to claim 3 wherein said means for moving said sound comprises pulse generator for delivering pulses dependent on the vertical movement of said sound and said means for recording responds to said pulses to correlate the output of said transducer with the depth of said sound.

* * * * *